US006808170B2

(12) United States Patent
Butikofer

(10) Patent No.: US 6,808,170 B2
(45) Date of Patent: Oct. 26, 2004

(54) IMAGING MEDIA SUPPLY TRAY

(75) Inventor: Chet M. Butikofer, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/285,274

(22) Filed: Oct. 30, 2002

(65) Prior Publication Data

US 2004/0084835 A1 May 6, 2004

(51) Int. Cl.[7] ..... B65H 3/44
(52) U.S. Cl. ..... 271/9.12; 271/145; 271/162
(58) Field of Search ..... 271/9.01, 9.12, 271/145, 162, 164

(56) References Cited

U.S. PATENT DOCUMENTS 4,303,235 A * 12/1981 Calabrese ..... 271/162
4,525,063 A * 6/1985 Eisbein ..... 355/72
5,405,128 A * 4/1995 Fujiwara et al. ..... 271/9.13
5,573,234 A * 11/1996 Petocchi ..... 271/9.01
5,624,108 A * 4/1997 Kubo ..... 271/9.12
6,264,195 B1 * 7/2001 Hoberock et al. ..... 271/226
6,267,371 B1 * 7/2001 Jessop ..... 271/171

* cited by examiner

*Primary Examiner*—David H. Bollinger

(57) ABSTRACT

An imaging media supply tray for providing imaging media to a feed mechanism of an imaging system a first access area adapted and constructed to contain a first quantity of imaging media in a position capable of exposing the first quantity of imaging media to the feed mechanism. A second access area adapted and constructed to contain a second quantity of imaging media in a position capable of exposing the second quantity of imaging media to the feed mechanism. A securing mechanism is adapted and constructed to selectively secure the imaging media supply tray in the imaging system in a first orientation connecting the first access area to the feed mechanism, or in a second orientation connecting the second access area to the feed mechanism.

23 Claims, 3 Drawing Sheets

IMAGING MEDIA SUPPLY TRAY

FIELD OF THE INVENTION

The present invention relates generally to imaging media supply trays for handling a variety of imaging media sizes in imaging systems.

BACKGROUND OF THE INVENTION

Many imaging systems, particularly printers, include imaging media supply holders, typically in the form of trays or drawers. Such supply holders contain a quantity of imaging media (sheets of paper, transparency material, labels, or the like) in such a way as to provide access to a feed mechanism of the imaging system. A common form of feed mechanism employs "pick and feed" rollers to lift the top sheet of material and introduce it into the imaging system for processing.

It is often desirable to use a variety of different-sized imaging media in a single imaging system. For example, correspondence in the United States is typically on U.S. Letter size paper, measuring 8.5 inches×11 inches, while European business is more frequently conducted using A4 size paper, which measures 8.272 inches×11.689 inches.

Not surprisingly, a variety of solutions have arisen in attempting to accommodate this problem. For example, printers have been provided with a plurality of input trays. While this approach is conceptually simple, it requires duplication not only of trays, but of pick mechanisms and materials handling paths as well.

Another approach is to provide selectively movable stops or "x and y" guides on the interior of the tray, effectively allowing the interior size of the tray to be adjusted, either to respective standard sizes, or to "custom" sizes. This approach requires the system user to remove the input tray, remove all of the material from the tray, adjust the guides to the desired size, place material into the tray, and replace the tray in the system. This level of operational complexity is undesirable, particularly when size changes are frequent. Further, guides are often delicate, and subject to improper adjustment or abuse.

Yet another approach holds different sized media in a stacked configuration in an auxiliary tray. Mechanisms within the tray permit a user to selectively move the auxiliary tray into a "pick" position when the media within the tray is desired. Although this approach is effective, it nonetheless requires additional mechanical complexity.

It can be seen from the foregoing that the need exists for simple, inexpensive media supply trays capable of handling a variety of imaging media sizes in imaging systems.

SUMMARY OF THE INVENTION

An imaging media supply tray for providing imaging media to a feed mechanism of an imaging system a first access area adapted and constructed to contain a first quantity of imaging media in a position capable of exposing the first quantity of imaging media to the feed mechanism. A second access area adapted and constructed to contain a second quantity of imaging media in a position capable of exposing the second quantity of imaging media to the feed mechanism. A securing mechanism is adapted and constructed to selectively secure the imaging media supply tray in the imaging system in a first orientation connecting the first access area to the feed mechanism, or in a second orientation connecting the second access area to the feed mechanism.

DETAILED DESCRIPTION OF THE INVENTION

Figure 1:
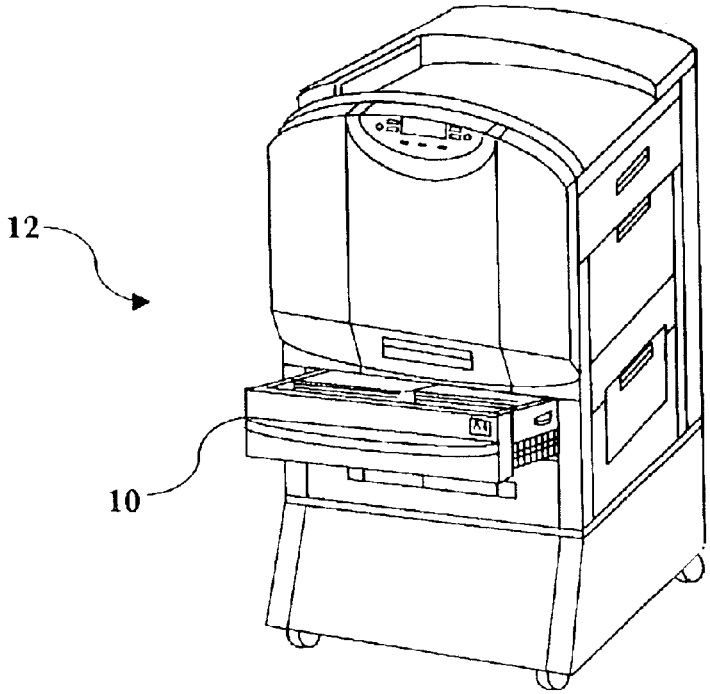
FIG. 1 is a schematic perspective view of an embodiment of an imaging system incorporating a media supply tray in accordance with the principles of the present invention.
Figure 2:
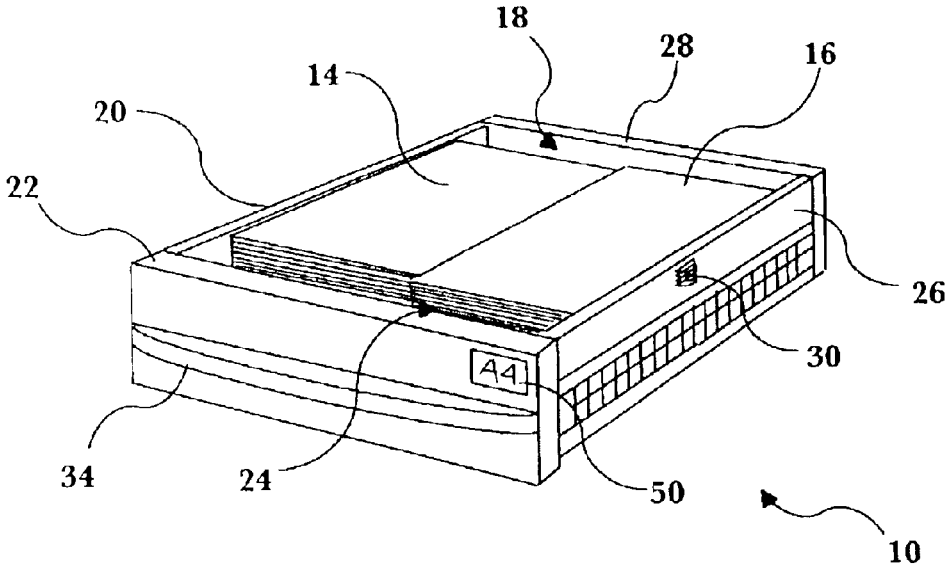
FIG. 2 is a schematic perspective view of an embodiment of a media supply tray in accordance with the principles of the present invention.
Figure 3:
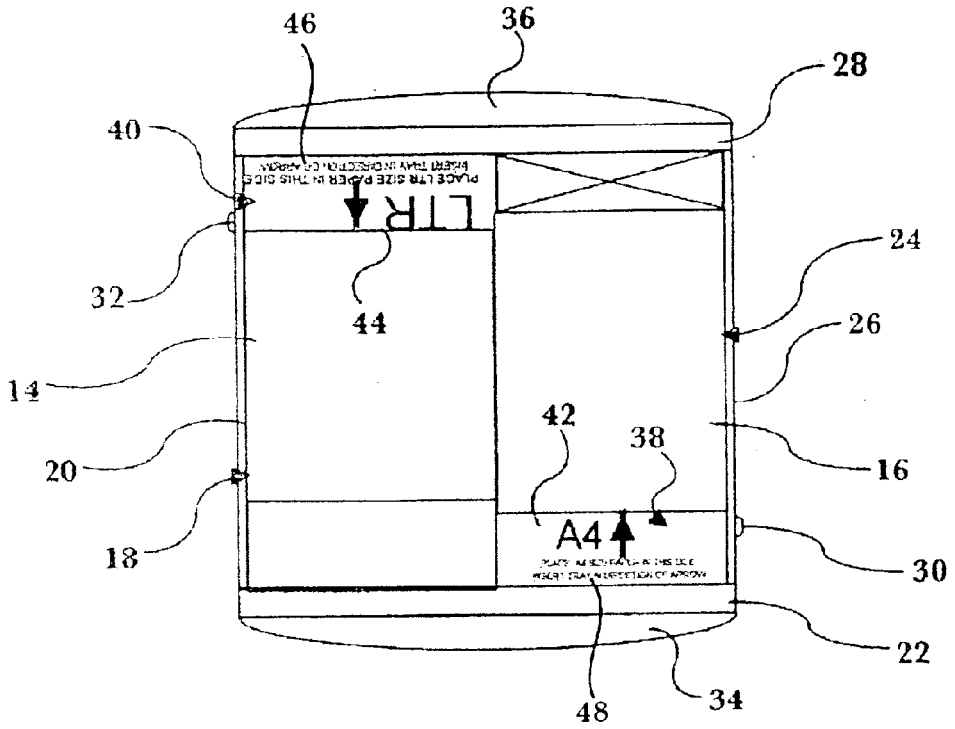
FIG. 3 is a schematic top plan view of the FIG. 2 media supply tray embodiment.
Figure 4:
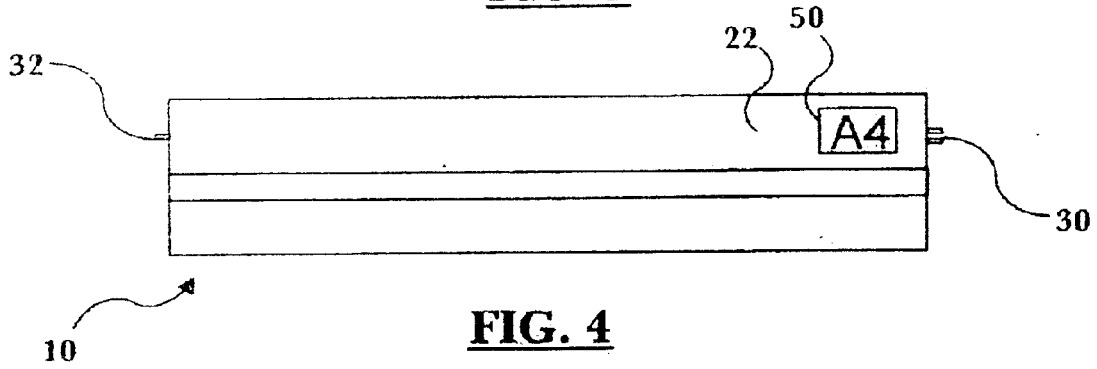
FIG. 4 is a schematic front elevational view of the media supply tray embodiment illustrated in FIG. 2.
Figure 5:
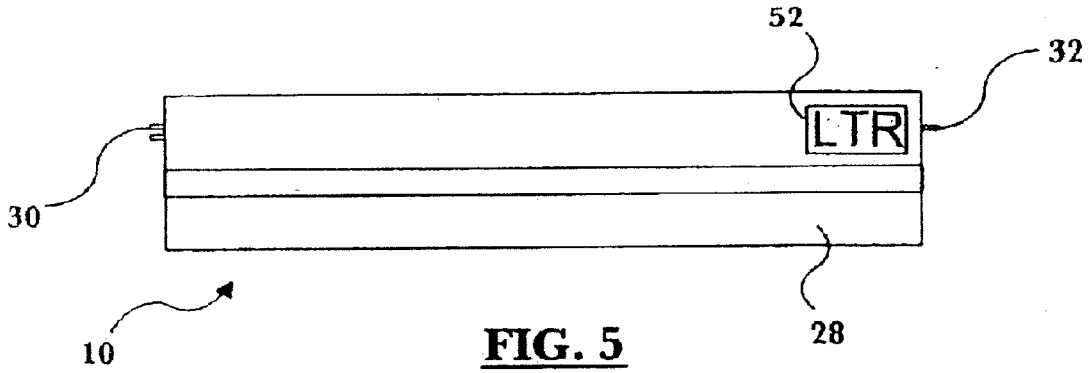
FIG. 5 is a schematic rear elevational view of the media supply tray embodiment illustrated in FIG. 2.

FIG. 1 illustrates an imaging media tray 10 representing one embodiment of the present invention. The imaging media tray 10 is adapted for use with an imaging system 12, here illustrated as a printer. The imaging media tray 10 holds respective to a feed mechanism of the imaging system 12. It is contemplated that the imaging media tray 10 will present imaging media within the imaging system 12 so that it can be infed via whatever feed mechanisms is employed by the imaging system 12, such as pick-and-feed rollers. It is contemplated that the shell of the tray 10 can be fabricated much more simply than conventional multi-piece trays, for example, by being injection-molded from a plastic material in a single piece. One or more lifting plates (not shown) can be added as needed to present the imaging media at a desired angle for picking, as is known in the art.

FIGS. 2–5 illustrate details of the imaging media tray 10. The imaging media tray 10 includes quantities of imaging media 14, 16 of distinct sizes. In the illustrated example, the quantity of imaging media 16 is A4 size, and the quantity of imaging media 14 is U.S. letter size. Of course, the imaging media tray 10 could be sized to accommodate any two desired sizes, or multiple quantities of the same size material. Material should be positioned for proper alignment with the pick rollers of the imaging system. The material is shown positioned in the tray 10 in a "centered" position, suitable for an imaging system having a left-to-right paper path, such as the HP 9000 printer. It is contemplated that the tray 10 can also accommodate other positioning configurations compatible with front-to-back and other paper paths, and that the principles of the present invention are applicable to other imaging systems, such as inkjet printers, copiers, and the like.

The quantity of imaging media 14 is contained within the imaging media tray 10 in an access area 18, defined by a side wall 20 and "front" end wall 22 of the imaging media tray 10. Similarly, the quantity of imaging media 16 is contained within the imaging media tray 10 in an access area 24, defined by a side wall 26 and "back" end wall 28 of the imaging media tray 10. The imaging media tray 10 is secured in the imaging system 12 by the dimensions and configuration of the side walls 20, 26. Keys 30, 32 are provided on an outer surface of the imaging media tray. In the illustrated embodiment, the keys are shown on the side walls 20, 26 of the imaging media tray 10, although they can be located on a bottom surface or any other suitable location. The keys 30, 32 have differing physical contours, and are constructed in a known manner to actuate switches on the interior of the imaging system 12 in order to indicate imaging material size to the control mechanism of the imaging system 12.

A handle 34 is provided on the end wall 22 of the imaging media tray 10, and a similar handle 36 is provided on the end wall 28 of the imaging media tray 10. The handles facilitate removal and insertion of the imaging media tray 10 into and out of the imaging system 12, and contribute to ease of carrying the imaging media tray 10 when it is outside the imaging system 12.

When the imaging media tray 10 is inserted into the imaging system 12 in the orientation shown in FIG. 1, the access area 24 exposes the quantity of imaging media 16 to the feed mechanism of the imaging system 12, thus connecting the access area 24 to the feed mechanism of the imaging system 12. The keys 30 actuate the appropriate switching mechanism within the imaging system 12, and the side wall 26 acts as an imaging material guide for the imaging media 16. When it is desired to use the quantity of imaging media 14, the imaging media tray is removed from the imaging system 12, rotated 180°, and reinserted into the imaging system 12. In this orientation, the access area 18 exposes the quantity of imaging media 14 to the feed mechanism of the imaging system 12, thus connecting the access area 18 to the feed mechanism of the imaging system 12. The keys 32 actuate the appropriate switching mechanism within the imaging system 12, and the side wall 20 acts as an imaging material guide for the imaging media 14.

A variety of mechanisms can be used to assist the user in placement of the imaging media within the imaging media tray 10. For example, indicia 38, 40 are affixed to the imaging media tray 10 adjacent to the access areas 18, 24. The indicia 38, 40 containing information regarding the imaging media size "A4" and "LTR", arrows 42, 44 pointing out the proper orientation of the tray to use the respective imaging media sizes, and brief instructions 46, 48. Additionally, labels 50, 52 can be placed on the end walls 22, 28 of the imaging media tray 10 to give a visual confirmation of the imaging media size loaded for use.

Figure 6:
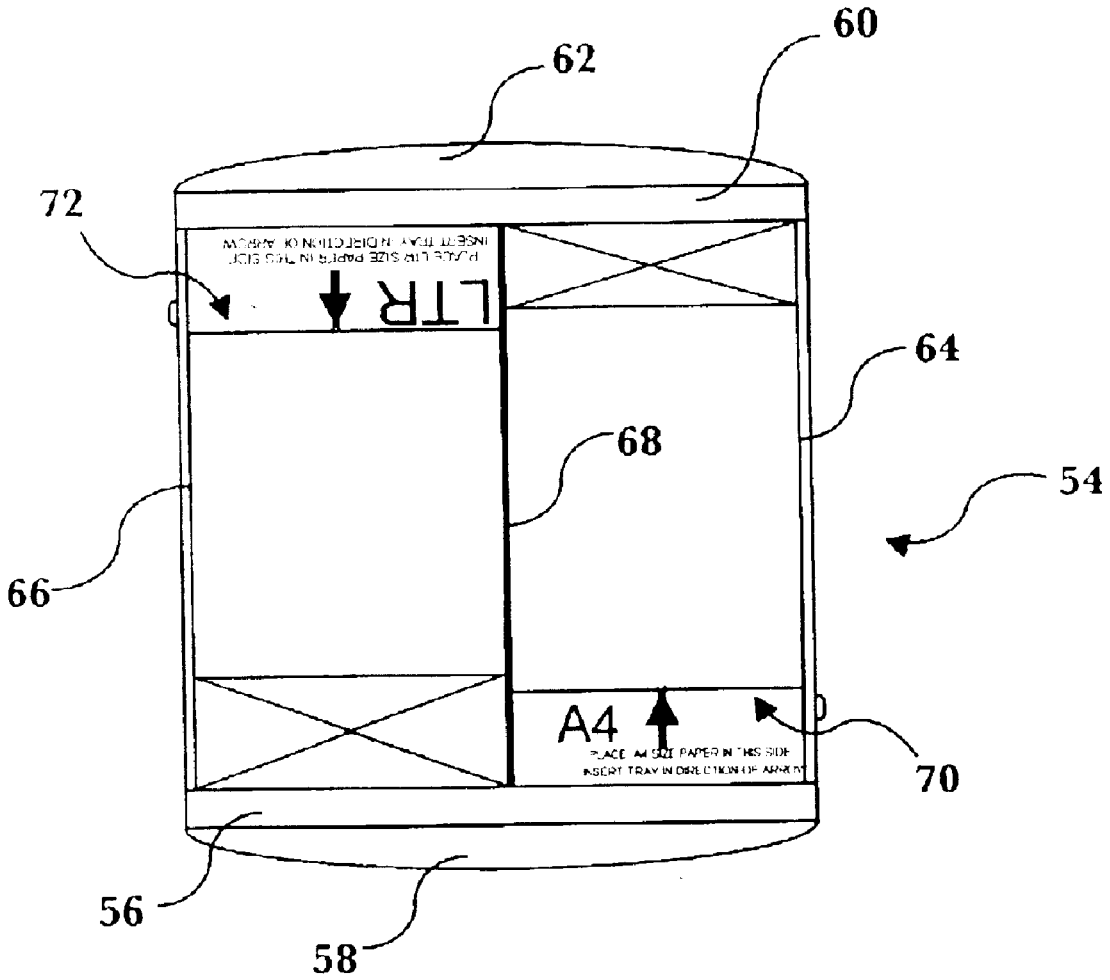
FIG. 6 is a schematic top plan view of another embodiment of a media supply tray in accordance with the principles of the present invention

An alternative embodiment of an imaging media tray 54 is illustrated in FIG. 6. The imaging media tray 54 includes a front end wall 56 with a handle 58, a back end wall 60 with a handle 62, a side wall 64, and a side wall 66, similar to the FIGS. 1–5 embodiment. On the interior of the imaging media tray 54, a dividing wall 68 separates an access area 70 from an access area 72. The access area 70 is formed by a section of the front end wall 56, a section of the back end wall 60, a surface of the side wall 64, and a surface of the dividing wall 68 parallel to the surface of the side wall 64. The access area 72 is formed by a section of the front end wall 56, a section of the back end wall 60, a surface of the side wall 64, and a surface of the dividing wall 68 parallel to the surface of the side wall 64. The access areas are connected to the feed mechanism of an associated imaging system by changing orientation of the imaging media tray 54, as described with respect to the FIGS. 1–5 embodiment.

It will be appreciated by those of skill in the art that this arrangement can be varied within the context of the illustrated embodiments. For example, the access areas can be configured and labeled to facilitate use of imaging media having characteristics differing in color, texture, or transparency, instead of or in addition to different sizes. The imaging media tray can be fabricated from any suitable material or combination of materials, including thermoplastics, metals, and the like.

Although the present invention has been described with reference to specific embodiments, those of skill in the art will recognize that changes may be made thereto without departing from the scope and spirit of the invention as defined by the appended claims.

What is claimed is:

1. An imaging media supply tray for providing imaging media to a feed mechanism of an imaging system, the imaging media supply tray comprising:

a first access area adapted and constructed to contain a first quantity of imaging media in a position configured to expose the first quantity of imaging media to the feed mechanism;

a second access area positioned laterally of the first access area and adapted and constructed to contain a second quantity of imaging media in a position configured to expose the second quantity of imaging media to the feed mechanism; and a securing mechanism adapted and constructed to selectively secure the imaging, media supply tray in the imaging system in a first orientation configured to expose the first access area to the feed mechanism and a second orientation configured to expose the second access area to the feed mechanisms, wherein the first access area and the second access area are arranged to be simultaneously positioned within the imaging system.

2. An imaging media supply tray in accordance with claim 1, wherein the first orientation is 180° from the second orientation.

3. An imaging media supply tray in accordance with claim 1, wherein the first access area comprises an imaging material guide formed by a first side wall of the imaging media supply tray.

4. An imaging media supply tray in accordance with claim 3, wherein the second access area comprises an imaging material guide formed by a second side wall of the imaging media supply tray, the second side wall of the imaging media supply tray being located opposite from the first side wall of the imaging media supply tray.

5. An imaging media supply tray in accordance with claim 1, further comprising indicia on a surface of the imaging media supply tray adjacent to the first and second access areas, the indicia containing information regarding an imaging media size and orientation of the imaging media supply tray.

6. An imaging media supply tray in accordance with claim 1, further comprising keys located on an exterior surface of the imaging media supply tray, the keys being adapted and constructed to actuate a size-indicating mechanism in the imaging system.

7. An imaging media supply tray in accordance with claim 1, further comprising handles located on respective end walls of the imaging media supply tray.

8. An imaging media supply tray in accordance with claim 1, wherein the feed mechanism of the imaging system comprises a feed mechanism of a printer.

9. An imaging media supply tray for providing imaging media to a feed mechanism of an imaging system, the imaging media supply tray comprising:

a first access area formed in the imaging media supply tray, the first access area having dimensions adapted and constructed to contain a first quantity of imaging media, the first access area being selectively positionable to permit feeding of imaging media from the first access area into the feed mechanism of the imaging system; and a second access area formed in the imaging media supply tray and positioned laterally of the first access area, the second access area having dimensions adapted and constructed to contain a second quantity of imaging media, the second access area being selectively positionable to permit feeding of imaging media from the second access area into the feed mechanism of the imaging system;

wherein the first access area and the second access area are arranged to be simultaneously positioned within the imaging system whereby insertion of the imaging media supply tray into the imaging system in a first orientation connects the first access area with the feed mechanism of the imaging system, and insertion of the imaging media supply tray into the imaging system in a second orientation connects the second access area with the feed mechanism of the imaging system.

10. An imaging media supply tray in accordance with claim 9, wherein the imaging media supply tray further comprises a front wall, a back wall, a pair of opposing side walls, and a dividing wall.

11. An imaging media supply tray in accordance with claim 10, wherein the first access area is formed by a section of the front wall, a section of the back wall, a first side wall of the pair of opposing side walls, and a surface of the dividing wall parallel to the first side wall of the pair of opposing side walls.

12. An imaging media supply tray in accordance with claim 11, wherein the second access area is formed by another section of the front wall, another section of the back wall, a second side wall of the pair of opposing side walls, and a surface of the dividing wall parallel to the second side of the pair of opposing side walls.

13. An imaging media supply tray in accordance with claim 12, wherein the first orientation is 180° from the second orientation.

14. An imaging media supply tray in accordance with claim 12, further comprising indicia on a surface of the imaging media supply tray adjacent to the first and second access areas, the indicia containing information regarding an imaging media size and orientation of the imaging media supply tray.

15. An imaging media supply tray in accordance with claim 12, further comprising keys located on an exterior surface of the imaging media supply tray, the keys being adapted and constructed to actuate a size-indicating mechanism in the imaging system.

16. An imaging media supply tray in accordance with claim 12, further comprising handles located on respective end walls of the imaging media supply tray.

17. An imaging media supply tray in accordance with claim 9, wherein the feed mechanism of the imaging system comprises a feed mechanism of a printer.

18. A method for providing discrete media supplies to a media supply feed system of an imaging device with a media supply tray, the media supply tray having discrete compartments positioned laterally of each other for each of the discrete media supplies, the method comprising:

inserting the media supply tray in a first orientation into the media supply feed system, including simultaneously positioning the discrete compartments of the media supply tray within the imaging device;

removing the media supply tray from the media supply feed system;

changing an orientation of the media supply tray to a second orientation; and inserting the media supply tray in the second orientation back into the media supply feed system, including simultaneously positioning the discrete compartments of the media supply tray within the imaging device.

19. A method in accordance with claim 18, wherein removing the media supply tray from the media supply feed system is further defined by pulling the media supply tray by a set of handles from the media supply feed system.

20. A method in accordance with claim 19, further comprising providing a label for contents of each of the discrete compartments on a section of the media supply tray such that the label for the contents is visible when the discrete compartment corresponding to the label is inserted into the media supply feed system.

21. A method in accordance with claim 18, further comprising providing a plurality of keyed levers on the media supply tray, the keyed levers corresponding to respective sizes of each of the discrete media supplies.

22. A method in accordance with claim 18, wherein inserting the media supply tray in the first orientation into the media supply feed system comprises inserting the media supply tray in the first orientation into the media supply feed system of a printer.

23. A method in accordance with claim 18, wherein inserting the media supply tray in the second orientation back into the media supply feed system comprises inserting the media supply tray in the second orientation back into the media supply feed system of a printer.

* * * * *

UNITED STATES PATENT AND TRADEMARK OFFICE

CERTIFICATE OF CORRECTION

PATENT NO. : 6,808,170 B2
DATED : October 26, 2004
INVENTOR(S) : Chet M. Butikofer It is certified that error appears in the above-identified patent and that said Letters Patent is hereby corrected as shown below:

Column 4,
Line 20, after "imaging" delete ",".

Signed and Sealed this

Thirtieth Day of August, 2005

JON W. DUDAS
*Director of the United States Patent and Trademark Office*